United States Patent [19]

Bernhardt

[11] 4,340,138

[45] Jul. 20, 1982

[54] MULTIPLE COMPARTMENT MULTIPLE SEAL CONTAINER

[76] Inventor: Daniel Bernhardt, P.O. Box 681, Rutland, Vt. 05701

[21] Appl. No.: 187,464

[22] Filed: Sep. 15, 1980

Related U.S. Application Data

[63] Continuation-in-part of Ser. No. 175,367, Aug. 5, 1980.

[51] Int. Cl.[3] ..... B65D 21/00; B65D 85/62

[52] U.S. Cl. ..... 206/216; 206/541; 220/23; 220/410; 220/307; 229/1.5 C; 229/15; 229/43

[58] Field of Search ..... 206/216, 541, 217, 526; 229/1.5 C, 15, 43; 220/307, 306, 410, 23, 462

[56] References Cited

U.S. PATENT DOCUMENTS

| | | | |
|---|---|---|---|
| 2,034,067 | 3/1936 | Stone | 229/1.5 C |
| 2,597,567 | 5/1952 | Como | 206/541 |
| 3,070,275 | 12/1962 | Bostrom | 220/307 |
| 3,344,974 | 10/1967 | Bostrom | 229/43 |
| 3,349,941 | 10/1967 | Wanderer | 220/410 |
| 3,514,029 | 5/1970 | Powell | 220/23 |

*Primary Examiner*—William T. Dixson, Jr.

*Attorney, Agent, or Firm*—Mark T. Basseches; Paula T. Basseches

[57] ABSTRACT

The present invention is directed to a multiple compartment, multiple seal container particularly adapted for packaging plural portions of foods or the like. The device comprises a first container formed of polymeric material or the like and a second container adapted to nest within the first container. A lid member having a skirt extending into the second container provides a seal therefor. The lid and first container, and preferably also the second container, include flange portions disposed in coplanar alignment. A membrane, such as a cellophane membrane, is disposed in registry with the first container and is sealed to the lid and to the first container, and optionally also to the second container, along continuous seal lines, to provide a composite package including discrete compartments having multiple seals.

2 Claims, 4 Drawing Figures

MULTIPLE COMPARTMENT MULTIPLE SEAL CONTAINER

This application is a continuation-in-part of my copending application Ser. No. 175,367 filed Aug. 5, 1980.

BACKGROUND OF THE INVENTION

1. Field of the Invention

The present invention is in the field of containers and particularly pertains to a multiple compartment container for the discrete packaging of comestibles or like articles, the containers being double sealed. One or more of the containers may preferably be temporarily reclosed following initial opening.

2. The Prior Art

It is known to provide packaging for the discrete storage of separate articles, such as separate food portions. In one form of multiple compartment package, a tray may be formed with two or more cavities which may be individually filled with food portions or the like. In order to seal the device, a membrane or the like is disposed over the tray and seals, such as heat seals, are formed between the membrane and areas of the surface of the tray surrounding the cavities.

It is likewise known to provide a container of shaped polymeric material having a single cavity and incorporating a surrounding planar flange to the uppermost surface of which a membrane may be secured as by heat sealing—see for example my U.S. Pat. No. 3,765,595 of Oct. 16, 1973 and various of the patent art cited therein.

In devices of the type hereinabove noted, the sole sealing or closing effect is provided by connection of the membrane to the plastic tray. Thus, once the membrane has been removed, the enclosure may not be reclosed.

Additionally, if by some mischance the membrane should be punctured, the contents of the package are no longer protected.

Further, and referring particularly to the multiple compartment container described hereinabove, the contents of the various compartments must be, as a practical matter, sealed simultaneously. Thus, it is not feasible first to fill one cavity or compartment and seal the same, and thereafter at some subsequent time fill a second cavity, since the handling inherent in such operation greatly complicates the manufacturing process.

SUMMARY OF THE INVENTION

The present invention may be summarized as directed to an improved receptacle for multiple food portions or the like which comprises a plurality of containers, each of which may be filled with articles or, more usually, comestibles of different types. The containers may be nested whereby an inner container defines a closure or seal for an outer container, the inner container in turn being separately sealed or closed by a lid. A membrane is thereafter sealingly connected to flange portions formed on the lid and on the outer container whereby the contents of both containers are hermetically sealed, providing a double seal effect. Preferably a frictional interfit is defined between the inner container and the mouth of the outer container and between the lid and the inner container whereby, even after opening as by removal of the membrane, a temporary reclosing of the containers is possible.

While the various embodiments of the invention hereinafter described have been illustrated in conjunction with a two container construction, it will be readily recognized that three or more containers may be embodied in a single unit.

More particularly, the outer container is provided with a permeable, outwardly directed planar flange having a recess area at the junction of the flange and the side walls.

The second container is likewise provided with a perimetal flange which is seated within the recess of the first container, the volume of the second container being smaller than that of the first, whereby there is defined between the containers a compartment for the receipt of a first article or potion.

A lid member likewise having an outwardly directed flange and including a depending skirt is mounted in the second container in such manner that the flange or shoulder of the lid is disposed over the mouth of the second container and in coplanar alignment with the flange of the first container.

A membrane which preferably is congruent with the flange of the first container is now positioned thereover.

First and second continuous seals, such as heat seals or, alternatively, adhesive seals, are effected respectively between the membrane and the first flange and between the membrane and the shoulder of the lid.

Preferably the second container is sized to define a frictional fit with the first container and the lid is sized to define a frictional fit with the second container whereby, after removal of the membrane, the chamber or compartment between the containers may be reclosed by reinsertion of the second container into the first and the chamber or compartment defined between the lid and the second container may be reclosed by replacement of the lid.

In using the device it is possible to open one of the compartments without compromising the seal of the other.

The device in accordance with the invention has the further advantage, as more fully set forth in my above referenced copending application, of providing a shock resistant composite when the containers are stacked one atop the other due to the cushioning effect of the stretched membrane on a similar container mounted with its under surface engaging the membrane.

Accordingly, it is an object of the invention to provide a multi-compartment, multi-seal container assembly.

A further object of the invention is the provision of a device of the type described which is subject to reclosing after removal of the membrane.

Still a further object of the invention is the provision of a package of the type described which is subject to being reclosed after opening.

Still a further object of the invention is the provision of a device of the type described which is particularly adapted for packing of foodstuffs which should be kept separated but which are intended for conjoint use, e.g. a cake mix and an icing portion intended to be spread on the baked product.

Still a further object of the invention is the provision of a package of the type described wherein the membrane, in addition to functioning as a sealant or barrier, also acts as a shock absorber whereby the contents of stacked packages are less likely to be crumbled or injured in shipping or storage.

To attain these objects and such further objects as may appear herein or be hereinafter pointed out, reference is made to the accompanying drawings, forming a part hereof, in which.

Figure 1:
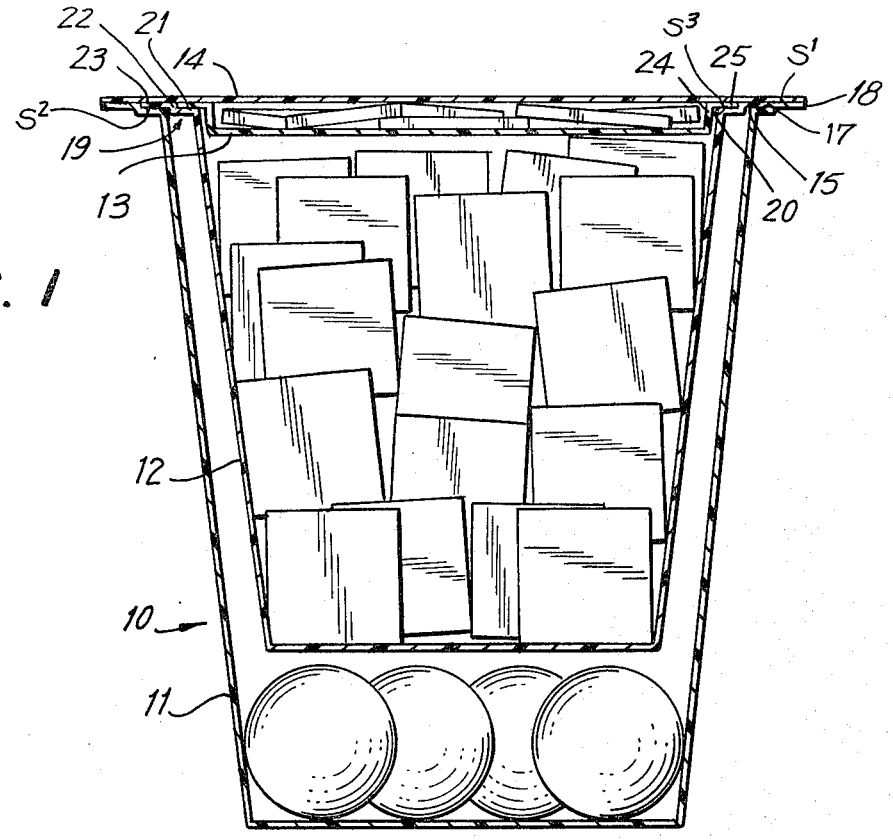
FIG. 1 is a vertical sectional view through a multiple compartment package in accordance with the invention.

Referring now to the drawings, there is shown in FIG. 1 a first embodiment of the invention comprising a multiple compartment container assembly 10 including a first or outer container 11 formed preferably of molded sheet or foamed polymeric material, such as an acetate, polyester, polystyrene or the like, a second container 12 which nests with the first container in the manner hereinafter set forth, a lid member 13 for sealing of the second container, and a film member 14 providing a double sealing function.

More particularly, the outer container 11 which, in the illustrated embodiment is square in transverse section but may be of any desired geometric configuration, e.g. circular, etc., includes a mouth portion 15 surrounded by a flange assembly 16. The flange assembly 16 includes a recessed portion 17 disposed between the mouth 15 and the flange member 18.

The inner container 12 includes a circumferential flange assembly 19 surrounding open mouth portion 20 thereof.

The flange assembly 19 includes a ledge member 21, an upwardly directed lip 22 and a flange member 23. The lip 22 is sized to define a frictional fit with the interior surfaces of the outer container 11 in the area immediately adjacent the mouth 15 thereof. The flange member 23 of the flange assembly 19 is sized to fit within the recessed portion 17 of the outer container. When thus positioned, the upwardly facing surfaces of the flange portions 18 and 23 are in coplanar alignment.

The lid member 13 includes a depending skirt 24 sized frictionally to fit in the open mouth portion 20 of the inner container and includes a laterally outwardly directed shoulder 25 sized to be seated on the ledge member 21 of the flange assembly 19.

The uppermost surface of the shoulder 25, in the inserted position of the lid within the inner container, is disposed in coplanar alignment with the uppermost surfaces of the flange portions 18 and 23.

In use, a food portion or the like is inserted within the first container 11, following which the second container 12 is positioned within the first container in the manner hereinabove set forth. A second portion may previously or thereafter be charged into the container 12, following which the lid 13 is applied. Thereafter, the membrane or film 14, which preferably is congruent with the outer dimensions of the flange portion 18 of the container 11, is disposed atop the said container.

In the embodiment of FIG. 1, three discrete, continuous seals $S^1$, $S^2$ and $S^3$ are formed between the membrane 14 and the flange portion 16, the flange portion 23, and the shoulder 25, respectively. Preferably, the continuous perimetal seals $S^1$, $S^2$, $S^3$ are formed by a heat sealing operation. However, it will be readily recognized that the said seals may be provided by forming a rectangular pressure sensitive border on the under surface of the film 14, which border registers with the noted flange portions and shoulder, whereby sealing is effected by merely applying the film and pressing the same into engagement with the respective flange portions and shoulder.

Alternatively, the entire under surface of the film 14 may be covered with a pressure sensitive material or an adhesive may be applied to the areas of the flanges and shoulder where a seal is to be formed, and the film affixed to such adhesive coated areas.

It will be observed that following affixation of the membrane or film 14, there is provided a composite container structure having at least two discrete compartments, namely, the compartment defined between container 11 and container 12 and the compartment defined between container 12 and the lid member 13.

It will be seen that a further compartment of limited volume is also defined between the upper surface of lid 13 and the film 14, which additional compartment may be utilized for retaining articles having relatively small volume, such as packets of salt, pepper, sugar, ketchup, a napkin, etc.

Additionally, it will be observed that each of the compartments is multiple sealed, one such seal being defined by the frictional interfit of the parts and the other such seal by the seal lines $S^1$, $S^2$, $S^3$.

As noted in my above referenced copending application, the lid and/or the flange portions of the respective containers may be provided with laterally directed tabs (not shown) to facilitate stripping and opening of the various compartments, or with an aperture or apertures through the flange area to facilitate attachment to a display rack, etc.

Figure 3:
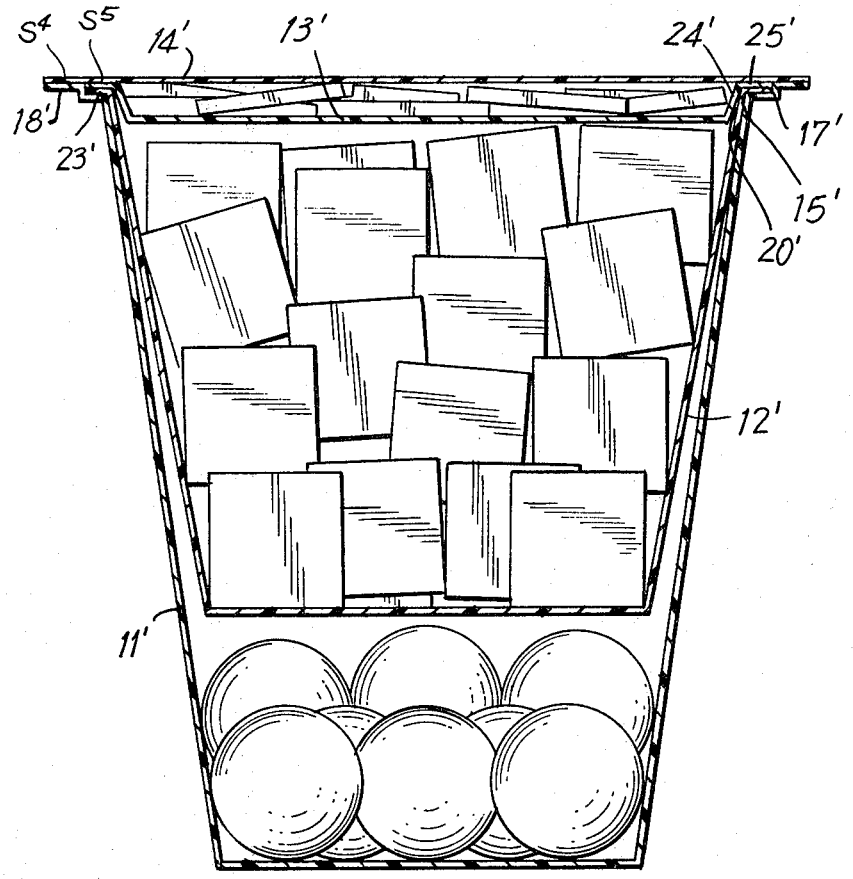
FIG. 3 is a vertical sectional view of a composite package in accordance with a further embodiment of the invention.
Figure 4:
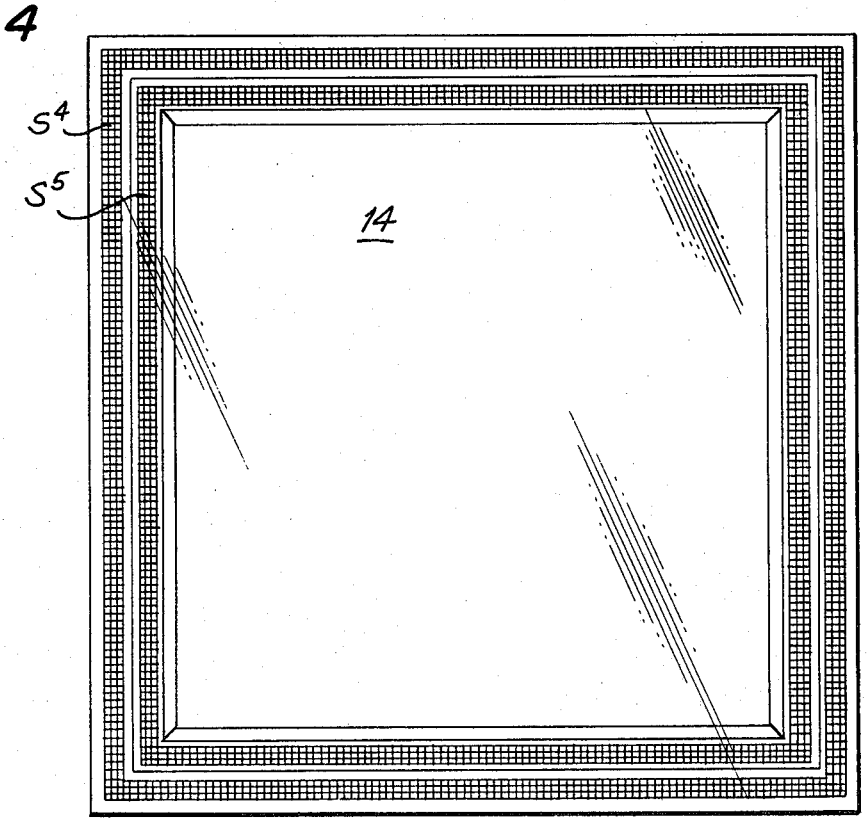
FIG. 4 is a plan view of the embodiment of FIG. 3.

In the embodiment of FIGS. 3 and 4, wherein like parts bear like reference numerals, the outer container 11' is provided with a recess 17' of slightly greater depth than the recess 17 of the embodiment of FIG. 1. The inner container 12' includes a laterally outwardly directed flange portion 23' which is seated in the recess 17'. In such seated condition, a frictional interfit is defined between the containers 11' and 12' adjacent the mouth portion 15' of the outer container.

The lid member 13' includes a depending skirt 24' sized frictionally to interfit with the mouth portion 20' of the inner container.

By virtue of the additional depth of the recess 17' of the outer container 11', the shoulder 25' of the lid 13' when seated over the flange portion 23' of the container 12' is disposed in coplanar alignment with the flange portion 18' of the container 11'.

Film 14' is applied in accordance with the previously described embodiment. However, in this case only two seals $S^4$ and $S^5$ are effected, respectively between the film and the flange portion 18' and the film and the shoulder 25'.

Figure 2:
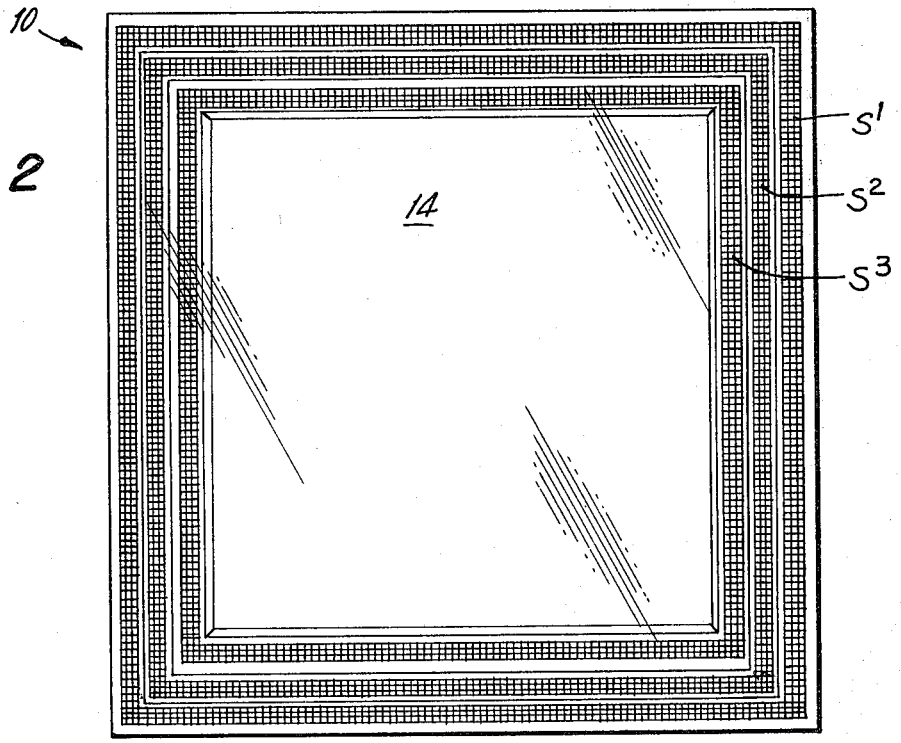
FIG. 2 is a plan view of the package of FIG. 1.

In all other respects and effects, the container of FIGS. 3 and 4 is similar to the container of FIGS. 1 and 2.

From the foregoing it will be understood that there is described and illustrated in accordance with the invention a multiple container structure which includes internesting containers which preferably define frictional seals with each other, in combination with a lid sealing the innermost container, and a film or membrane sealingly connected along multiple seal lines to the container structures to define a positive second seal protecting and hermetically isolating the contents of the containers.

While the illustrated embodiments disclose structures incorporating two discrete containers and a lid, it will be readily recognized that three or more such containers may be provided, all of which, in accordance with the invention, would be sealed both by their engagement with other containers (or a lid) and by their sealed connection with the covering film or membrane. Since access to an interiorly located container is prevented not only by the seal extending between the film and that container but also by the seals joining the film to outer containers, the contents of inner containers will be perceived to be particularly securely isolated from the atmosphere.

The containers in accordance with the invention will possess certain of the advantages of the containers described and claimed in my above referenced copending application, and particularly will embody the mutually shock-resistant feature as more fully set forth in said application.

Those skilled in the art and familiarized with the instant disclosure may readily derive modifications and variations of details of the construction without departing from the spirit of the invention. Accordingly, the invention is to be broadly construed within the scope of the appended claims.

Having thus described the invention and illustrated its use, what is claimed as new and is desired to be secured by Letters Patent is:

1. A multiple compartment package for foods or the like comprising a first container having a bottom, side walls defining a mouth, and a planar flange extending laterally outwardly beyond said mouth, a continuous recess interposed between said flange and said mouth, a second, seperable container mounted in said first container, said second container having a mouth and a laterally directed perimetal flange seated in said recess of said first container and defining a closure therefor, a lid disposed in sealing position of said second container and including a skirt portion disposed within said second container and forming a frictional interfit with said second container adjacent said mouth and a perimetal shoulder portion overlying the mouth of said second container and in substantial coplanar alignment with said flange of said first container, a membrane disposed in covering relation of said first container, and a continuous seal connection defined between said film and the upper surface of said flange of said first container, said membrane functioning to maintain said second container and said lid in closing relation of the mouth of said first container and the mouth of said second container, respectively.

2. A multiple compartment receptacle for food or the like comprising a first container having a bottom and side wall portions extending upwardly from said bottom, the upper extremities of said wall portions defining an open mouth portion, a laterally directed ledge member extending outwardly from said upper extremities of said side wall portions, a rim portion extending from the outer extremity of said ledge member, an outwardly directed perimetal flange extending from the upper extremity of said rim, a second separable container mounted in said first container, the second container being of lesser volume than said first container and including a bottom, side walls defining an open mouth and a circumferential flange extending laterally beyond the upper extremity of said side walls, said flange of said second container being substantially congruent with and seated on said ledge member, said side walls of said second container defining a frictional fit with said first container adjacent the mouth thereof, a lid mounted in closing relation of said mouth of said second container, said lid including a depressed skirt portion extending within and frictionally engaging the walls of said second container, a laterally outwardly directed shoulder extending from said skirt of said lid and seated on said circumferential flange of said second container, said shoulder and the flange of said first container being in substantial coplanar alignment, a resilient closure film overlying said first container and a substantially continuous perimetal seal defined between said film and the upper surfaces of said flange of said first container, whereby said film functions to retain said second container in said frictional fitting position within said first container and said lid in said frictional fitting position within said second container.

* * * * *